United States Patent [19]

Goettel

[11] Patent Number: 4,744,379

[45] Date of Patent: May 17, 1988

[54] CONVEYOR SYSTEM FOR WASHING APPARATUS

[76] Inventor: Andrew P. Goettel, 4818 47th Street, Camrose, Alberta, Canada, T4V 1J6

[21] Appl. No.: 844,101

[22] Filed: Mar. 26, 1986

Related U.S. Application Data

[63] Continuation-in-part of Ser. No. 832,473, Feb. 20, 1986.

[51] Int. Cl.[4] ..... B08B 3/02

[52] U.S. Cl. ..... 134/109; 134/133; 134/137; 134/165; 134/200; 248/129; 5/63

[58] Field of Search ..... 134/104, 109, 133, 137, 134/165, 200, 201; 248/129; 211/151; 414/401, 284, 663; 5/63, 81 R

[56] References Cited

U.S. PATENT DOCUMENTS

| | | | |
|---|---|---|---|
| 2,471,506 | 5/1949 | Wiswall . | |
| 2,633,399 | 3/1953 | Haas . | |
| 2,947,311 | 8/1960 | Fox et al. | 134/72 X |
| 3,071,178 | 1/1963 | Howeth . | |
| 3,345,994 | 10/1967 | Felton . | |
| 3,372,704 | 3/1968 | Ashworth . | |
| 3,422,826 | 1/1969 | Ballard . | |
| 3,439,689 | 4/1969 | Zadron et al. . | |
| 3,452,763 | 7/1969 | Ballard . | |
| 3,498,304 | 3/1970 | Rumbaugh | 134/93 X |
| 3,624,750 | 11/1971 | Peterson . | |
| 3,656,491 | 4/1972 | Ballard . | |
| 3,814,414 | 6/1974 | Cnapa | 269/328 X |
| 3,921,653 | 11/1975 | Ducharme . | |
| 3,930,879 | 1/1976 | Erickson et al. . | |
| 4,143,669 | 3/1979 | Minkin . | |
| 4,170,240 | 10/1979 | Gentry . | |
| 4,217,920 | 8/1980 | Ballard . | |
| 4,265,583 | 5/1981 | Baird et al. | 414/284 |
| 4,408,625 | 10/1983 | Kuhl . | |
| 4,433,698 | 2/1984 | Blaul . | |
| 4,671,728 | 6/1987 | Clark et al. | 414/401 |

FOREIGN PATENT DOCUMENTS

| | | |
|---|---|---|
| 995101 | 8/1976 | Canada . |
| 1016043 | 8/1977 | Canada . |
| 1086188 | 9/1980 | Canada . |

*Primary Examiner*—Harvey C. Hornsby
*Assistant Examiner*—Frankie L. Stinson
*Attorney, Agent, or Firm*—Fulwider, Patton, Rieber, Lee & Utecht

[57] ABSTRACT

This invention is directed to a washing system designed primarily for washing automotive parts, and in addition to a washer having a cabinet, a working chamber within the cabinet, and a support table within the cabinet, an improved conveying system is provided to transport parts to be cleaned from a location such as an automotive work station, to the interior of the washing chamber and to transport cleaned parts back to the work station or to storage.

The conveying system comprises a mobile carrier having an article supporting tray carried on the upper surface of the carrier and which can be easily pushed into the working chamber of the washer and removed therefrom back onto the mobile carrier. Parallel track or guide means are provided in the top of the mobile carrier and on top of a turntable within the washing chamber to facilitate moving the article supporting tray, which is preferably provided with wheels which are suitable to ride on the parallel tracks or guide means provided.

7 Claims, 5 Drawing Sheets

18
4
3
11
10
3
70
71
14
16
17
24
12
15
25
32
4
23
13
54
59
46
20
47
2
60
26
63
27
33
56
30
62
31
2

CONVEYOR SYSTEM FOR WASHING APPARATUS

This application is a continuation application of copending application Ser. No. 06/832,473, filed on Feb. 20, 1986 and now pending.

BACKGROUND OF THE INVENTION

This invention generally relates to a washing apparatus and particularly to a washing apparatus suitable for cleaning automotive parts and other similar articles.

Parts removed from automotive vehicles for repair or replacement characteristically have heavy layers of oil and/or grease, tenacious deposits of baked-on carbonaceous material, dirt, sand, and the like. To facilitate working on these automotive parts, they are usually cleaned in a highly caustic, aqueous detergent solution.

There are many different types of automotive parts washing apparatus that have been sold in the marketplace and described in the prior art literature. The following list of patents illustrate some of the prior art washing apparatus. The list of patents is intended to be exemplary, not exhaustive on the subject.

| PATENT NO. | PATENTEE |
|---|---|
| U.S. PAT. NO. 2,471,506 | Wiswall |
| U.S. PAT. NO. 2,633,399 | Haas |
| U.S. PAT. NO. 3,071,178 | Howeth |
| U.S. PAT. NO. 3,345,994 | Felton |
| U.S. PAT. NO. 3,422,826 | Ballard |
| U.S. PAT. NO. 3,439,689 | Zadron et al. |
| U.S. PAT. NO. 3,452,763 | Ballard |
| U.S. PAT. NO. 3,624,750 | Peterson |
| U.S. PAT. NO. 3,656,491 | Ballard |
| U.S. PAT. NO. 3,921,653 | Ducharme |
| U.S. PAT. NO. 3,930,879 | Erickson et al. |
| U.S. PAT. NO. 4,133,340 | Ballard |
| U.S. PAT. NO. 4,143,669 | Minkin |
| U.S. PAT. NO. 4,170,240 | Gentry |
| U.S. PAT. NO. 4,217,920 | Ballard |
| U.S. PAT. NO. 4,408,625 | Kuhl |
| U.S. PAT. NO. 4,433,698 | Blaul |
| CAN 995,101 | Lee |
| CAN 1,016,043 | Buchagger et al. |
| CAN 1,086,188 | Alexander |

The typical prior art automotive parts washing apparatus generally comprises an enclosed cabinet having a door in the front of the cabinet to provide access to a washing chamber disposed within the cabinet. A support table, usually rotatable, is provided in the bottom of the washing chamber to support the articles to be cleaned. Frequently, a wheeled basket is used to hold the parts to be cleaned, and rails or other guide means are fixed to the upper surface of the support table and used to facilitate moving the parts in and out of the washer in the wheeled basket. One or more spray bars or manifolds are provided within the washing chamber to spray cleaning fluid at the articles disposed therein.

In most automotive repair shops, machine shops and the like, centrally located floor space is for the most part taken up by equipment designed to perform the primary functions of such places. Parts washing devices are very difficult to place in such shops because they need to be connected to electrical, plumbing, and frequently gas facilities. As a result, parts washers are usually placed in less than desirous locations from the standpoint of transporting dirty parts from a work station to the washer and then returning the cleaned parts back to the work station or to a storage area.

With most of the prior art parts washing systems, the parts to be cleaned were either hand carried to the washer or placed in a carrier and transported to the washer in the carrier. In both cases, however, the parts would have to be hand loaded into the washer for cleaning which is labor intensive and time consuming.

What has been needed and heretofore unavailable is an effective parts conveying system integral with the washer which minimizes the time and effort required to clean automotive parts and the like. The present invention satisfies this need.

SUMMARY OF THE INVENTION

This invention is directed to a washing system and particularly to an improved conveying system for transporting automotive parts and the like to and from a washing apparatus.

In accordance with the invention, the washing system includes a washer having a cabinet, a washing chamber within the cabinet, a door in the front of the cabinet to provide access to the washing chamber, and means to spray cleaning fluid on the surface of articles placed within the washing chamber.

Integral with the washing system is an improved conveying system for transporting dirty articles to be cleansed from a distant location, such as an automotive shop work station, to the washer, loading the dirty articles into the washer, unloading the cleaned articles from the washer, and then transporting cleaned articles from the washer back to a distant location, such as to the work station or to storage.

The conveying system basically comprises a support table mounted within the washing chamber having spaced-apart parallel tracks or guide means secured to the upper portion thereof; a mobile carrier, such as a wheeled cart or trolley, having spaced-apart parallel tracks or guide means secured to the upper portion thereof, which are spaced apart essentially the same distance as the tracks or guide means on the support table and are adapted to be aligned therewith; and an article support tray, preferably wheeled, which is supported by and movable on the track or guide means on the support table and the wheeled carrier. When both sets of tracks or guide means are aligned, the article support tray may be conveyed into and out of the washing chamber on the tracks or guide means.

The article support tray is prevented from moving on the tracks or guide means on the mobile carrier while the mobile carrier is being moved by a suitable latching mechanism.

The mobile carrier and the article support tray attached thereto are moved to a location, such as an automotive shop work station, where one or more parts to be cleaned are placed on the support tray. The mobile carrier with the parts to be cleaned thereon is moved in front of the opened access door of the washer with the tracks or guide means on the mobile carrier and support frame within the washing chamber in alignment. The support tray with the parts is pushed into the washing chamber, the mobile carrier is pulled back from the washer to disengage the matching tracks or guide means, and the washer door is closed. The washing of the articles therein can then begin.

Upon completion of the washing cycle, the washer door is opened, the mobile carrier is repositioned in front thereof with the matching track or guide means thereon in alignment with the track or guide means on the support table within the washing chamber so that the article support tray with the clean parts therein may be pulled from the washing chamber onto the mobile carrier which may then be transported to a desired location where the clean parts are unloaded.

The present invention provides an improved system for conveying large and small auto parts and other similar articles to and from a washing apparatus. The system is easily used and does not involve an extensive amount of labor. These and other features of the invention will become more apparent from the following detailed description thereof and the accompanying exemplary drawings.

DETAILED DESCRIPTION OF THE INVENTION

Figure 1:
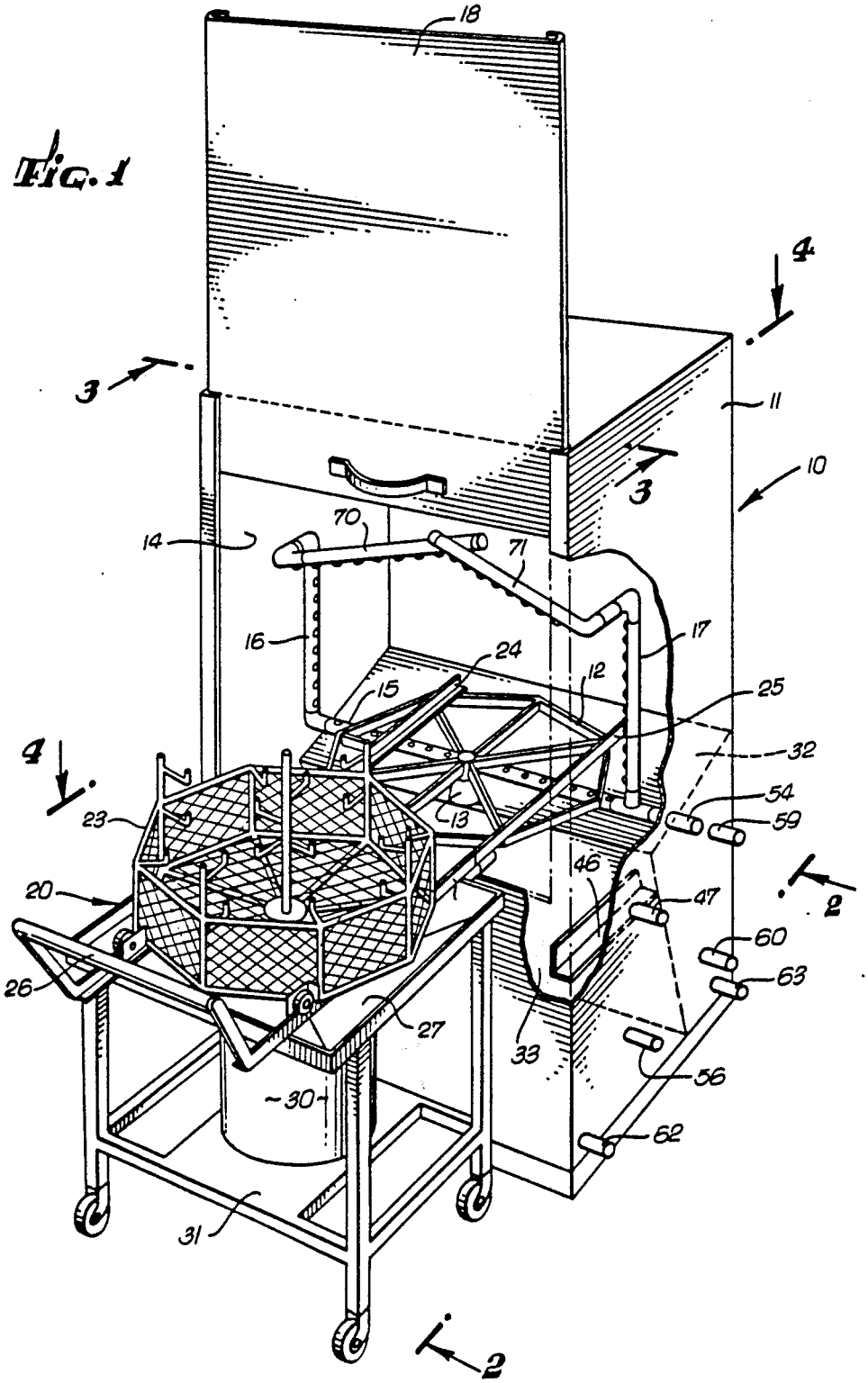
FIG. 1 is a perspective view of a washing apparatus which embodies features of the invention.

Reference is made to FIGS. 1–4 which illustrate a washing system 10 embodying features of the invention. The washer 10 generally includes a cabinet 11, an article support frame or turntable 12, which is rotatably mounted on a spindle 13 located in the lower portion of a washing chamber 14, horizontal spray manifold 15 underneath the support frame 12, and a plurality of upstanding spray manifolds 16 and 17 extending therefrom are disposed within the washing chamber 14 to spray cleaning fluid toward automotive parts or other articles supported on table 12. An access door 18 is provided in cabinet 11 to allow for the loading and unloading of the washer 10.

The conveyor system embodying features of the invention includes a mobile carrier or trolley 20 having secured to the upper surface thereof parallel track or guide means 21 and 22 which are adapted to receive a wheeled article support tray or basket 23. Matching track or guide means 24 and 25 are secured to the upper surface of support frame or turntable 12 disposed within the washing chamber 14 and are adapted to receive the wheeled article support tray or basket 23 from the trolley 20.

The trolley 20 is pushed by means of handle 26 to a distant location, such as a work station at an automotive repair shop, and one or more parts to be cleaned are placed in the wheeled tray or basket 23, which is detachably fixed onto the trolley 20 by a latching means (not shown), and then the trolley 20 is pushed to the washer 10 and positioned in front of open door 18 with the track or guide means 21 and 22 aligned with the track or guide means 24 and 25 securely mounted on the turntable 12. In this manner, the parts to be cleaned can be loaded into the washing chamber 14 by pushing the wheeled tray 23 containing the dirty parts from the trolley or carrier 20 onto the turntable 12 in the washing chamber 14. The trolley 20 is pulled back so the access door 18 in the front of cabinet 11 can be pulled down to a closed position and the washing cycle can be then started. To unload the cleaned parts from the washer 10, the door 18 is lifted upwardly to an open position and the wheeled tray 23 is pulled out of chamber 14 onto the trolley 20. A latching means (not shown) is engaged so that the wheeled tray 23 will not move on tracks 21 and 22 while the trolley 20 is being moved. With the tray 23 fixed, the clean parts may then be transported back to the work station or, if desired, to a storage area where the clean parts may be removed from the wheeled tray 23.

Figure 2:
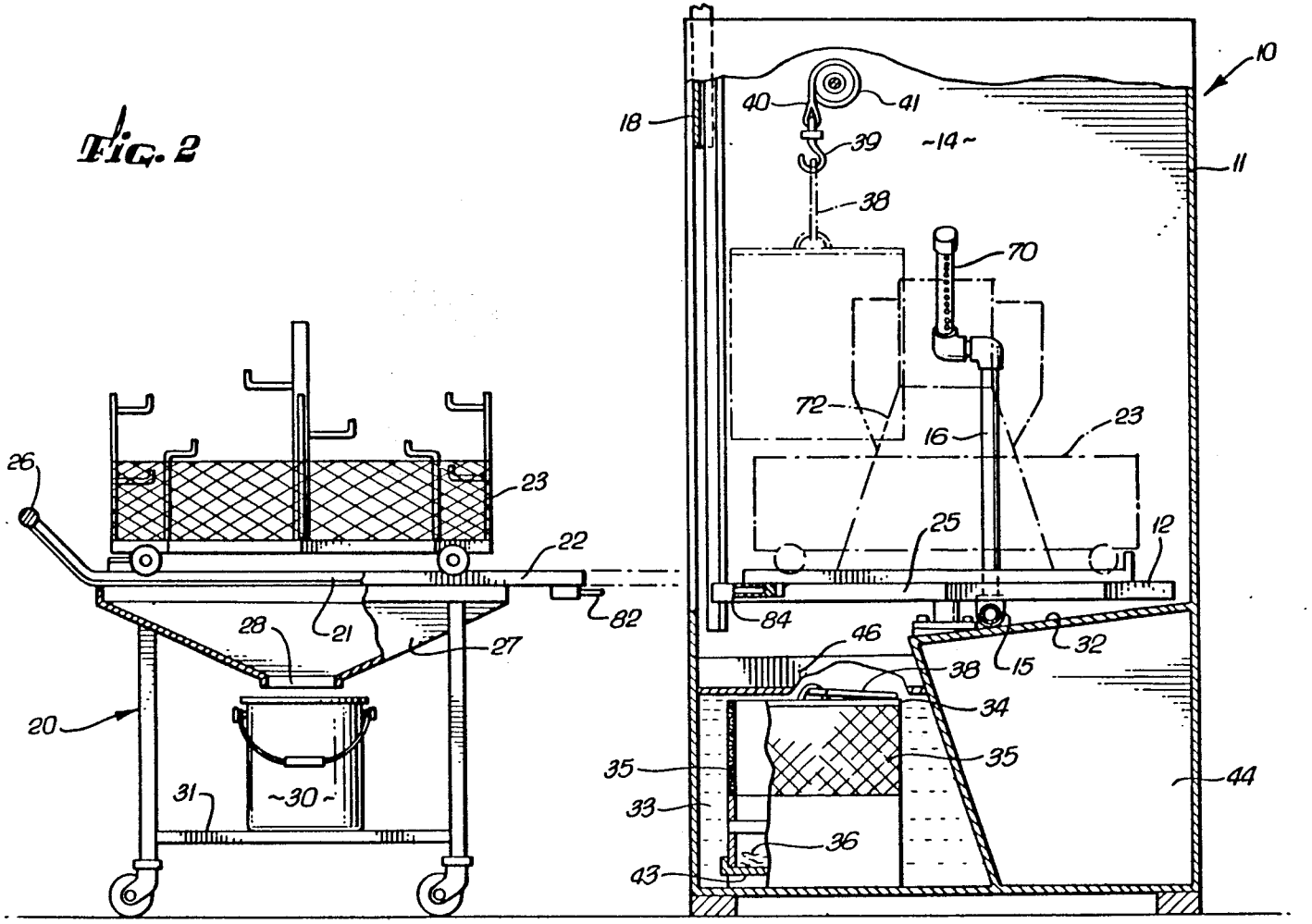
FIG. 2 is a cross-sectional view taken along the lines of 2—2 shown in FIG. 1.

As shown more clearly in FIG. 2, cart or trolley 20 is provided with a drain pan 27 for capturing fluid and other material which may drain or fall from the objects placed in the wheeled tray or basket 23 and directing the material through opening 28 into a collecting container or pail 30 disposed on a lower shelf 31 of cart 20.

Figure 3:
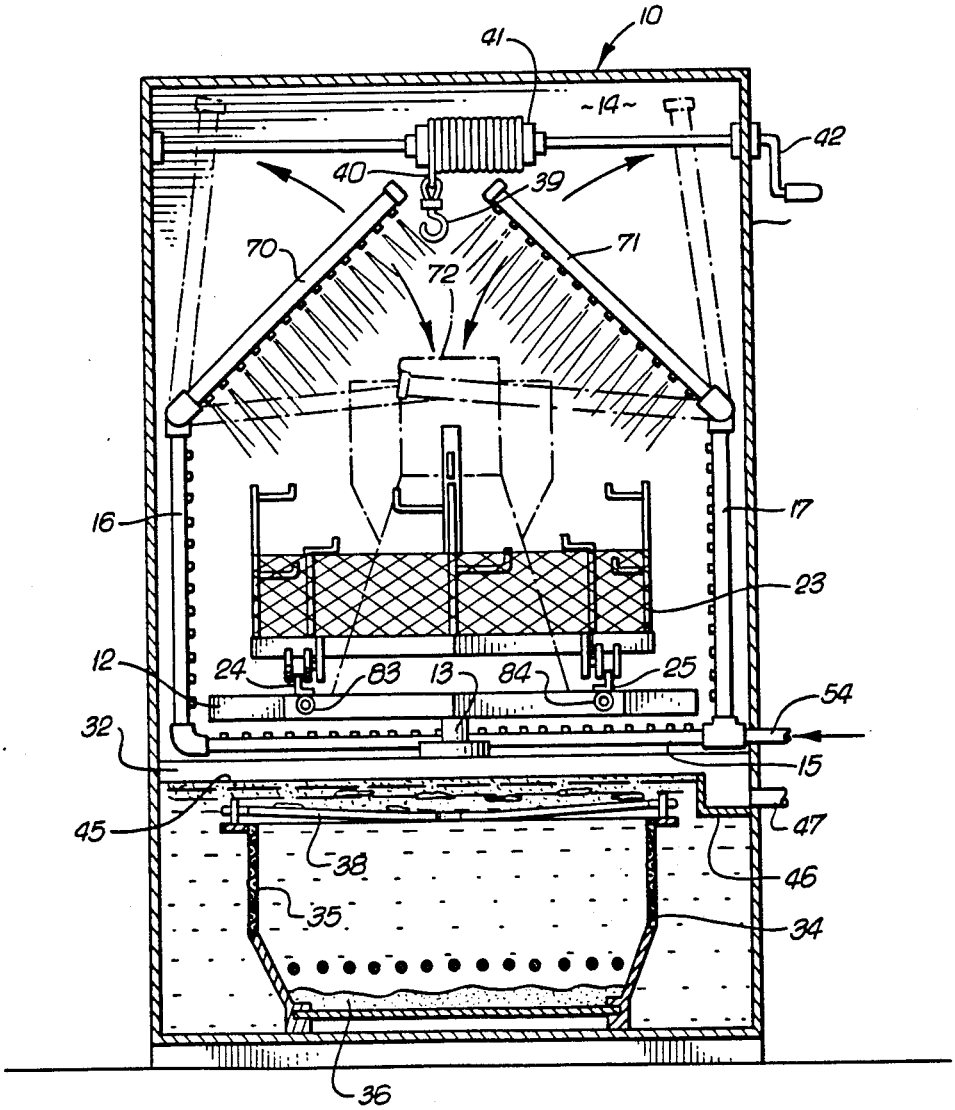
FIG. 3 is a cross-sectional view taken along the lines 3—3 shown in FIG. 1.
Figure 4:
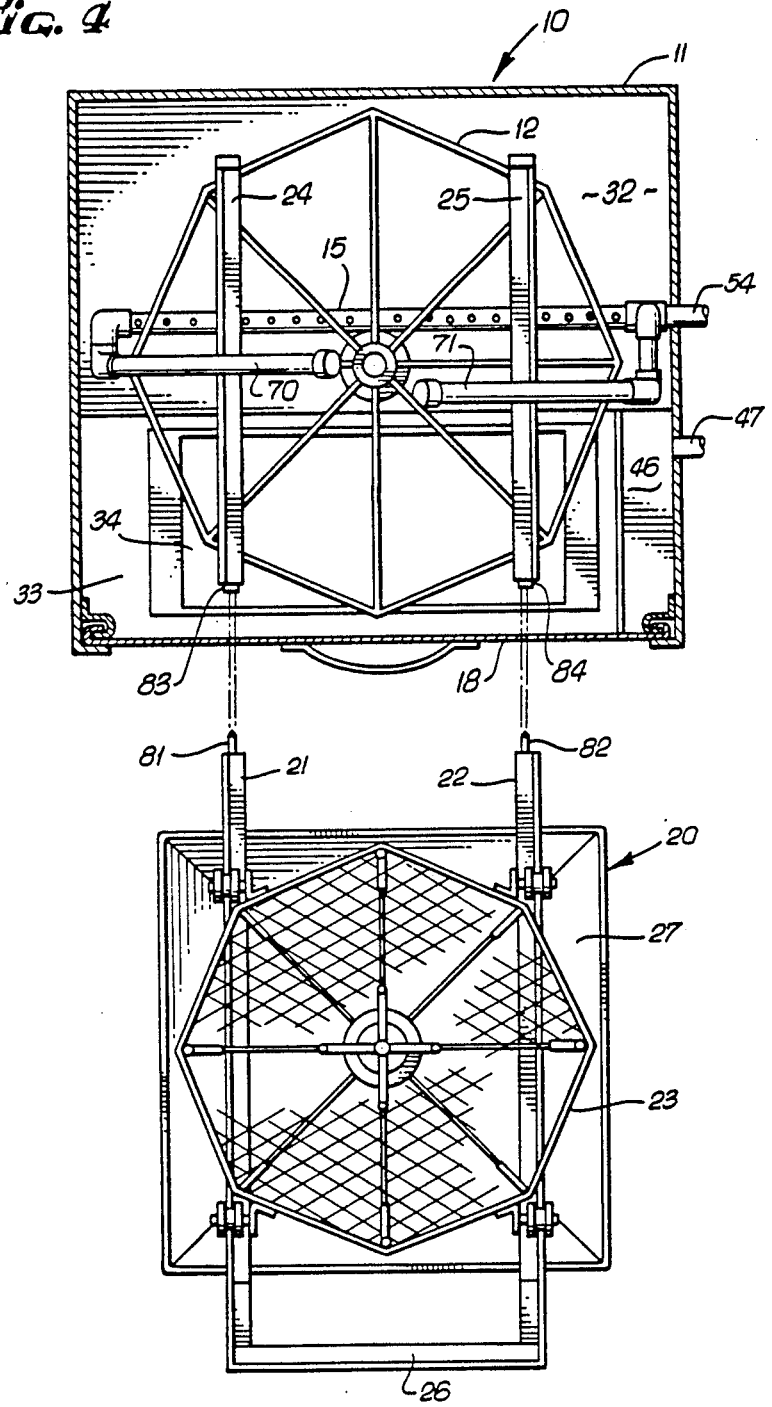
FIG. 4 is a cross-sectional view taken along the lines 4—4 shown in FIG. 1.
Figure 6:
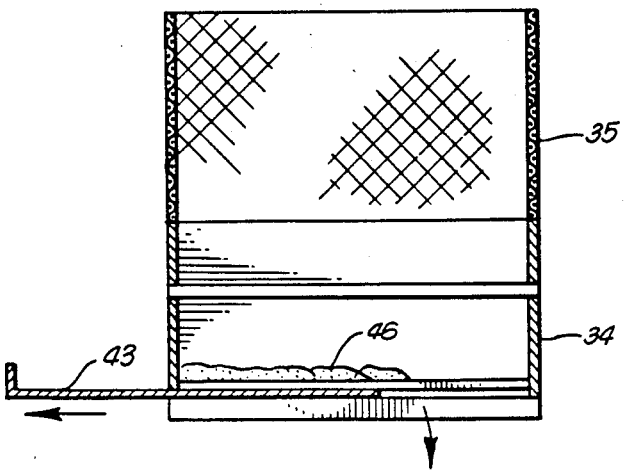
FIG. 6 is a side view of an opened-top container which, as shown in FIGS. 2–4, is disposed in the lower portion of the washing apparatus.

The cleaning solution sprayed on the articles in the washing chamber 14 drains down inclined surface 32 into a working tank 33 disposed in the lower portion of the cabinet 11 beneath the support frame 12 as described in the present inventor's copending application Ser. No. 832,473, filed on Feb. 20, 1986. A particulate capturing container 34 is provided within the working tank 33 having one or more openings or a screen 35 in the walls thereof so that the cleaning solution may pass through such walls when the container 34 is lifted from the working tank 33, yet the solid particulate material 36 which separates from the cleaning solution is retained therein. The turntable 12 must be lifted from spindle 13 and either removed from the chamber or leaned against a far wall thereof so that the container 34 can be lifted through opening 37, removed from the washer 10, and the sludge 36 and other particulate therein discarded. As indicated in FIGS. 2, 3 and 6, a handle 38 is preferably provided on the container 34 so that it may be lifted by means of a hook 39 on a cable 40 wound on a pulley 41 operated by crank 42. When the container 34 is lifted by the hook 39 out of the working tank 33, the cart or trolley 20 may be pushed forwardly so that the leading edges of rails 21 and 22 are under the container 34. Container 34 can then be lowered onto the rails 21 and 22 and then be manually pulled further back onto the rails. If desired, wheels can be provided on container 34 to facilitate movement on the rails 21 and 22. When properly positioned on the rails 21 and 22, the slidable bottom 43 of the container 34 may be pulled open so that the solids 36 and other material therein will drop into the drain pan 27, through discharge opening 28 therein and into pail 30 supported on shelf 31 of the cart 20.

A second or holding tank 44 is provided in the lower portion of the washing unit 10 adjacent to the working tank 33 to hold cleaning solution while the working tank 33 is being cleaned or otherwise serviced. The low-density materials 45, such as oil and grease, which float to the surface of the cleaning solution are skimmed therefrom into a trough 46 disposed along one side of working tank 33. A discharge line 47 and valve 48 are provided in the wall of the cabinet 11 on which trough 46 is disposed to discharge the low-density materials 45 therein. Both solids and liquids may be skimmed.

Figure 5:
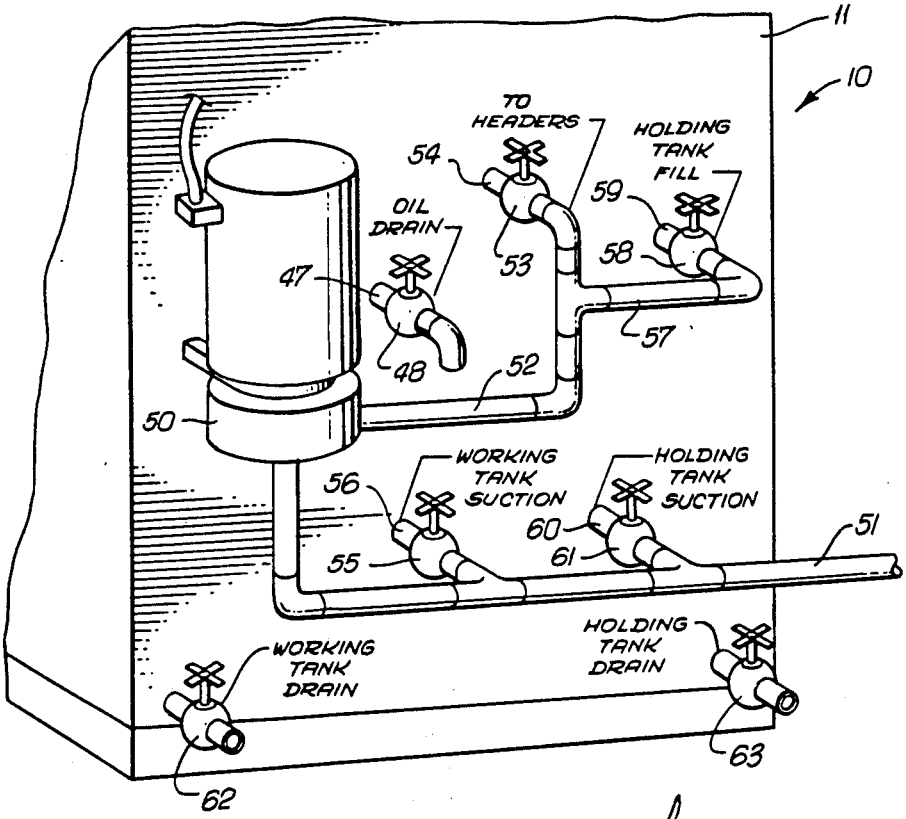
FIG. 5 is a perspective view of the pump and piping arrangement.

FIG. 5 illustrates a pumping element 50 and associated piping arrangement which is used to transfer cleaning fluid from the working tank 33 to the spray manifolds 15, 16, and 17, from the working tank 33 to the holding tank 44, and from the holding tank 44 back to the working tank 33.

Cleaning solution is supplied to washer 10 through a line 41 from a source thereof which is not shown in the drawings. The pump 45 directs the cleaning solution from inlet line 51 to the spray headers 15, 16, and 17 through pump discharge line 52, valve 53, and line 54 to thereby direct cleaning solution to automotive parts or other objects disposed in the washing chamber 14. The spent cleaning solution drains down inclined surface 32 into the working tank 33. Valves 53 and 55 are both held open during the washing cycle so the cleaning solution can be continuously recycled from the work tank 33 through line 56 back to the spray headers 15, 16, and 17.

At such time as when it becomes necessary or desirable to clean up or otherwise service the cleaning solution, the pump 50 is turned off and the cleaning solution in the working tank 33 is allowed to stand in a quiescent condition so the low-density materials 45 may float to the top thereof and the higher-density particulate matter 36 may settle to the bottom of the working tank 33. The low-density materials 45 which rise to the top of the cleaning solution are skimmed into the trough 46 and discharged from the washer through line 47 and valve 48. The container 34 in working tank 33 which captures the high-density particulate 36 is removed from the working tank 33 so the sludge and other particulate 36 can be discharged therefrom. The time for removing the container 34 is not critical.

The cleaning solution in working tank 33 is withdrawn therefrom through line 56 and valve 55 by pump 50 and directed to the holding tank 44 through lines 52 and 57, valve 58 and line 59. Valve 53 on line 54 is closed off when pumping fluid to holding tank 44 to prevent cleaning fluid from being directed to the spray headers 15, 16, and 17. After the working tank 33 has been cleaned or serviced, the cleaning solution is withdrawn from the holding tank 44 through line 60, valve 61, and conduit 51 to the pump 50 which directs the solution to the working tank 33 by spraying the cleaning solution onto the articles placed within the washing chamber 14 which then drains back to the working tank 33. If desired, a separate line with a suitable valve element may be provided to pump cleaning fluid withdrawn from the holding tank 35 directly to the working tank 30. Valves 62 and 63 are provided in the lower portions of working tank 33 and holding tank 44, respectively, to further facilitate cleaning of such tanks. It is contemplated, however, that the valves 62 and 63 will seldom be used. After servicing the work tank 33, the sludge container 34 may be lowered into the working tank 33 by pulley 41 and crank 42 and then the washer 10 is ready for a further washing cycle.

As shown more clearly in FIG. 3, the vertical rising spray headers 16 and 17 are provided with pivotal arms 70 and 71 which facilitate washing automotive parts of widely varying sizes in the washing unit 10. For example, should a transmission housing 72 be placed in the washing chamber 14, as shown in phantom, the arms 70 and 71 would be pushed upwardly so that the transmission housing 72 would fit thereunder. If however, the wheeled support tray 23 is filled with smaller automotive parts, such as alternator or starter housings, the spray arms 70 and 71 would be pivoted downwardly to a more horizontal position as shown in phantom so that the cleaning solution can be directed more closely to the parts to be cleaned.

The horizontal manifold 15, which is disposed underneath the support frame 12, has one or more nozzles which are aligned to impinge upon elements of the support frame 12 with sufficient horizontal force to rotate the frame 12 about the spindle 14 so that the cleaning solution can be sprayed evenly onto the parts disposed in the wheeled tray or basket 23.

To load and unload the washer 10, the vertically rising door 18 is lifted upwardly to an open position and the cart or trolley 20 is positioned in front of the opening thereof with the rails 21 and 22 thereon in proper alignment with rails 24 and 25 on the upper surface of the support table 12 in order to move the wheeled tray or basket 23 into and out of the washing chamber 14. As shown more clearly in FIGS. 2, 3, and 4, the rails 21 and 22 are provided with male guiding elements 81 and 82 which are adapted to fit into the matching recesses 83 and 84 provided in the front ends of rails 23 and 24 to ensure proper alignment of the rails and thereby enable the easy movement of the mobile basket 23 between the washing chamber 14 and the cart or trolley 20.

Although the invention is described herein primarily in terms of conveying automotive parts to and from a washing apparatus, it should be recognized that other types of articles may be conveyed in such a system. Additionally, the article support frame is described herein as rotating in a horizontal plane by the impingement thereon of cleaning fluid from the spray header, although it should be recognized that the support frame may be fixed and the underlying spray header may rotate. Other, modifications and improvements can be made to the present invention without departing from the scope thereof.

What is claimed is:

1. An article washing system which includes (a) a washer comprising a cabinet, a washing chamber within the cabinet, means in one of the cabinet walls to provide access to the washing chamber from the exterior thereof, means to spray cleaning fluid onto articles supported within the washing chamber; and (b) a conveying system for transporting articles to be cleaned from a distant location to the washer, for loading the articles to be cleaned into the washer, for unloading cleaned articles from the washer and transporting the cleaned articles to a distant location, comprising:

(i) a support table mounted within the washing chamber having guide means secured thereto;

(ii) a mobile carrier having guide means secured to the upper surface thereof which are adapted to be aligned with the guide means secured to the support table mounted in the washing chamber and having a catch pan secured under the guide means with a drain to direct material which falls into the pan to a container mounted on the mobile carrier beneath the drain; and (iii) an article support tray adapted to be conveyed into and out of the washing chamber by means of the guide means on the mobile carrier and the support table to thereby load articles into and to unload articles out of the washer.

2. The washing system of claim 1 wherein the guide means include at least two parallel tracks.

3. The article washing system of claim 2 wherein the conveying system includes means to interconnect the parallel tracks secured to the support table and the parallel tracks secured to the upper surface of the mobile carrier.

4. The washing system of claim 2 wherein the article support tray is provided with wheels adapted to ride the parallel tracks secured to the mobile carrier and the support table.

5. The washing system of claim 1 wherein a working tank is provided underneath the washing chamber to capture cleaning fluid directed to articles within the washing chamber, a particulate-capturing container is disposed within the working tank and means are provided within the washing chamber to remove the particulate-capturing container from the working tank and hold the particulate-capturing container within the chamber so that guide means can be positioned underneath the container to facilitate removal of the container from the washing chamber.

6. The washing system of claim 5 wherein the particulate-capturing container is provided with the walls having a plurality of fluid draining openings for draining cleaning fluid from the container but which retain essentially all the particulate therein.

7. The washing system of claim 5 wherein the particulate-capturing container is provided with a discharge door which allows for the discharge of particulate from the particulate-capturing container into the catch pan under the tracks or guide means on the mobile carrier.

* * * * *